US011817644B2

(12) United States Patent
Tsai

(10) Patent No.: US 11,817,644 B2
(45) Date of Patent: Nov. 14, 2023

(54) ELECTRICAL CONNECTOR AND METHOD OF MANUFACTURING THE SAME

(71) Applicant: LOTES CO., LTD, Keelung (TW)

(72) Inventor: Yu Lun Tsai, Keelung (TW)

(73) Assignee: LOTES CO., LTD, Keelung (TW)

( * ) Notice: Subject to any disclaimer, the term of this patent is extended or adjusted under 35 U.S.C. 154(b) by 244 days.

(21) Appl. No.: 17/528,282

(22) Filed: Nov. 17, 2021

(65) Prior Publication Data

US 2022/0239024 A1 Jul. 28, 2022

(30) Foreign Application Priority Data

Jan. 26, 2021 (CN) ..... 202110103504.6

(51) Int. Cl.

| | |
|---|---|
| ***H01R 13/24*** | (2006.01) |
| ***H01R 12/71*** | (2011.01) |
| ***H01R 12/73*** | (2011.01) |
| ***H01R 43/02*** | (2006.01) |
| *H01R 13/627* | (2006.01) |

(52) U.S. Cl.

CPC ..... *H01R 12/716* (2013.01); *H01R 12/732* (2013.01); *H01R 43/0256* (2013.01); *H01R 13/6273* (2013.01)

(58) Field of Classification Search

CPC ..... H01R 12/716; H01R 12/732; H01R 43/0256; H01R 13/6273; H01R 13/2442; H01R 13/6471; H01R 12/7082; H01R 13/405; H01R 43/16; H01R 43/24; H01R 12/7076; H01R 13/02; H01R 43/20

See application file for complete search history.

(56) References Cited

U.S. PATENT DOCUMENTS 6,585,527 B2 * 7/2003 Koopman ..... H01R 13/2435 439/71
6,749,440 B1 * 6/2004 Szu ..... H01R 12/714 439/515

(Continued)

FOREIGN PATENT DOCUMENTS

CN 1082265 C 4/2002
CN 211126153 U 7/2020

*Primary Examiner* — Abdullah A Riyami
*Assistant Examiner* — Nelson R. Burgos-Guntin
(74) *Attorney, Agent, or Firm* — Locke Lord LLP; Tim Tingkang Xia, Esq.

(57) ABSTRACT

An electrical connector includes an insulating body, multiple lower terminals, a conductive plate, and multiple upper terminals. Each lower terminal has a base portion. The lower terminals include lower signal terminals connected to the plate and lower ground terminals separated from the plate. The upper terminals include upper signal terminals and upper ground terminals. Each upper terminal has a fixing portion and an elastic arm. The fixing portion is located above and fixed to the base portion. A metal sheet exists between two adjacent fixing portions of the upper terminals in the left-right direction and separated from the upper signal terminals. The sheet is integrally connected with the upper ground terminals adjacent thereto in the left-right direction and is separated in the front-rear direction. The sheet is located above and fixed to the plate. The elastic arm is located right above the front upper terminal adjacent thereto or the sheet.

12 Claims, 8 Drawing Sheets

(56) References Cited

U.S. PATENT DOCUMENTS

| | | | | |
|---|---|---|---|---|
| 6,942,495 | B2 * | 9/2005 | Liao | H01R 13/2435 439/71 |
| 7,900,347 | B2 | 3/2011 | Rathburn | |
| 7,988,501 | B2 * | 8/2011 | Chang | H05K 7/1069 439/873 |
| 8,911,242 | B2 * | 12/2014 | Jeon | H01R 13/2442 439/66 |
| 10,381,755 | B2 * | 8/2019 | Chang | H05K 3/3436 |
| 11,217,955 | B1 * | 1/2022 | Ho | H01R 43/16 |
| 2020/0328550 | A1 * | 10/2020 | Chen | H01R 12/714 |
| 2021/0305754 | A1 * | 9/2021 | Ho | H01R 12/7082 |
| 2022/0200184 | A1 * | 6/2022 | Ho | H01R 13/2442 |
| 2022/0200223 | A1 * | 6/2022 | Ho | H01R 13/50 |
| 2022/0209442 | A1 * | 6/2022 | Liu | H01R 12/7076 |
| 2022/0239024 | A1 * | 7/2022 | Tsai | H01R 43/0256 |
| 2023/0039986 | A1 * | 2/2023 | Huang | H01R 43/16 |
| 2023/0070662 | A1 * | 3/2023 | Jin | H01R 43/007 |
| 2023/0075216 | A1 * | 3/2023 | Jin | H01R 43/16 |

* cited by examiner

B-B

ELECTRICAL CONNECTOR AND METHOD OF MANUFACTURING THE SAME

CROSS-REFERENCE TO RELATED PATENT APPLICATION

This non-provisional application claims priority to and the benefit of, pursuant to 35 U.S.C. § 119(a), patent application Serial No. CN202110103504.6 filed in China on Jan. 26, 2021. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and a method of manufacturing the same, and particularly to an electrical connector electrically connecting a chip module and a circuit board and a method of manufacturing the same.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

To satisfy the high frequency signal transmission requirement of the existing chip module, the pads of the existing chip module are arranged in high density to transmit more signals, that is, the distance between the pads is reduced. With the increasing quantity of the terminals of the LGA electrical connector, the terminal arrangement becomes denser, and the distance between the terminals correspondingly becomes shorter.

The Chinese Patent No. 99119994.4 discloses an electrical connector, and the method of manufacturing the same includes the steps of: firstly, a metal strip is integrally punched to form a plurality of terminal blanks and connecting portions located on the same plane with the metal strip, and the terminal rough blanks are mechanically electrically connected together by the connecting portions. Each terminal rough blank includes a pair of wing portions, and the wing portions are provided to extend laterally from a main body portion of each terminal rough blank along opposite directions. Secondly, the insulating body covers an upper surface and a lower surface of the metal strip, and the metal strip is clamped therebetween. The insulating body is provided with a plurality of first openings aligned to the terminal rough blanks and second openings aligned to the connecting portions. Thirdly, an assisting tool is used to act on the terminals and the connecting portions through the first and second openings, such that the free ends of each terminal bend on the upper and lower end surfaces of the insulating body. Finally, the connecting portions are separated from the terminals.

However, to achieve a shorter distance between the terminals in the lateral direction, the lengths of the wing portions are limited by the metal strip, such that the length of each wing portion is shorter, which results in bad elasticity of the wing portions, and easily causing ill contact between the wing portions and the pads of the chip module. If the lengths of the wing portions are increased, the distance between the terminals in the lateral direction is increased, which cannot satisfy the design requirement to have a shorter distance between the terminals.

Therefore, a heretofore unaddressed need to design a novel electrical connector exists in the art to address the aforementioned deficiencies and inadequacies.

SUMMARY

In view of the deficiency of the background, the present invention is directed to an electrical connector and a method of manufacturing the same, which may achieve the short distance between the terminals and a long elastic arm of each terminal.

To achieve the foregoing objective, the present invention adopts the following technical solutions.

An electrical connector is configured to electrically connect a mating component to a circuit board. The electrical connector includes: an insulating body; a plurality of lower terminals and a conductive plate, wherein the insulating body, the lower terminals and the conductive plate are insert-molded; each of the lower terminals has a base portion and a conductive portion integrally connected to the base portion, the conductive portion is exposed downward to the insulating body to abut or be soldered to the circuit board; the lower terminals comprise a plurality of lower signal terminals and a plurality of lower ground terminals, the conductive plate is integrally connected to the lower ground terminals, and the conductive plate is separated from the lower signal terminals; and a plurality of upper terminals arranged in a plurality of columns in a left-right direction and arranged in a plurality of rows in a front-rear direction, wherein the upper terminals comprise a plurality of upper signal terminals and a plurality of upper ground terminals; each of the upper terminals and each of the lower terminals are formed separately, each of the upper terminals has a fixing portion and an elastic arm integrally connected to the fixing portion, the fixing portion is located above the base portion and is fixed to the base portion, the elastic arm has a contact portion configured to abut the mating component, the contact portion is located in front of the fixing portion and is higher than the fixing portion; wherein a metal sheet exists between two adjacent ones of the fixing portions of the upper terminals in the left-right direction, the upper signal terminals are separated from the metal sheet, the metal sheet is integrally connected with the upper ground terminals adjacent thereto in the left-right direction and is separated from the upper ground terminals adjacent thereto in the front-rear direction, the metal sheet is located above the conductive plate and is fixed to the conductive plate, and a portion of the elastic arm is located right above the upper terminal or the metal sheet adjacent thereto in the front-rear direction.

In certain embodiments, the portion of the elastic arm is located right above the upper terminal adjacent thereto in the front-rear direction, and the elastic arm passes forward beyond the metal sheet.

In certain embodiments, a front end of the elastic arm is located right above the fixing portion of another one of the upper terminals.

In certain embodiments, a through slot exists between the conductive plate and the base portion, each of a left side and a right side of the fixing portion of each of the upper signal terminals is provided with a cutting surface, and the cutting surface is exposed to the through slot.

In certain embodiments, each of a left side and a right side of the base portion of each of the lower signal terminals is provided with a breaking surface, and the breaking surface and the corresponding cutting surface are located on a same vertical plane.

In certain embodiments, the insulating body has a plurality of accommodating slots running vertically therethrough, the base portion has a first portion accommodated in a corresponding one of the accommodating slots, the first portion and a portion of the conductive plate surroundingly provided outside the first portion are exposed to the corresponding one of the accommodating slots, and the fixing portion is fixed to the first portion.

In certain embodiments, the first portion is provided horizontally, the fixing portion is fixed to the first portion by laser soldering, the base portion has a second portion extending horizontally forward from a front end of the first portion and then bending downward and extending, the second portion is fixed by the insulating body, the conductive portion is formed by extending downward from the second portion, a rear end of the first portion passes backward beyond a rear end of the corresponding fixing portion, and the front end of the first portion passes forward beyond a front end of the corresponding fixing portion.

A method of manufacturing an electrical connector is provided. The electrical connector is configured to electrically connect a first mating component and a second mating component. The method includes: step 1: providing a lower metal plate, and cutting the lower metal plate to form a plurality of lower terminals, wherein each of the lower terminals has a base portion and a conductive portion integrally connected to the base portion, the conductive portion is configured to be electrically connected to the circuit board, a remaining portion of the lower metal plate after forming the lower terminals is defined as a conductive plate, and the conductive plate has a plurality of connecting portions integrally connected to the base portions of the lower terminals; step 2: forming an insulating body on the lower terminals and the conductive plate by insert-molding, wherein a portion of the base portion is covered by the insulating body, and the conductive portion is exposed downward to the insulating body; step 3: providing a plurality of upper metal plates, wherein each of the upper metal plates comprises a plurality of upper terminals provided in a row in a left-right direction and a plurality of metal sheets integrally connected to the upper terminals, each of the upper terminals comprises a fixing portion and an elastic arm integrally connected to the fixing portion and bending upward, the elastic arm has a contact portion configured to abut the mating component, the contact portion is located in front of the fixing portion and is higher than the fixing portion, the upper terminals comprise a plurality of upper signal terminals; the upper metal plates are fixed to the lower metal plate and are provided at intervals in a front-rear direction, such that of two of the upper metal plates in the front-rear direction, a portion of the elastic arm of the upper metal plate located therebehind overlaps with the upper metal plate located in front thereof viewing along a vertical direction, the fixing portion is located above the base portion and is fixed to the base portion, and the metal sheets are located above the conductive plate and are fixed to the conductive plate; and step 4: cutting the upper signal terminals, such that the upper signal terminals are separated from the metal sheets.

In certain embodiments, in the step 3, the portion of the elastic arm is located right above the metal sheet adjacent thereto in the front-rear direction, and the elastic arm passes forward beyond the metal sheet adjacent thereto in the front-rear direction.

In certain embodiments, the lower terminals comprise a plurality of lower signal terminals; and after the step 3, the connecting portions connected to the lower signal terminals are cut, such that the lower signal terminals are separated from the conductive plate.

In certain embodiments, a breaking position of each of the lower signal terminals and a corresponding one of the connecting portions and a breaking position of each of the upper signal terminals and a corresponding one of the metal sheets in the step 4 are located on a same vertical plane.

In certain embodiments, when the lower terminals are cut in the step 1, a through slot is formed between the conductive plate and the base portion, and a breaking position of each of the upper signal terminals and a corresponding one of the metal sheets in the step 4 is exposed to the through slot.

Compared with the related art, the electrical connector and the method of manufacturing the same according to certain embodiments of the present invention has the following beneficial effects.

The upper terminals are formed on the upper metal plates (and not a single metal plate), so the length of the elastic arm located therebehind is not limited by the metal sheet or the upper terminal located in front thereof. In addition, the terminals are formed by upper terminals and lower terminals, thus achieving a short distance between the terminals and a long elastic arm of each terminal. Further, the insulating body is insert-molded with the lower metal plate, and then the upper metal plates are fixed to the lower metal plate, thereby implementing a simple and fast mounting process of the upper terminals and the lower terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
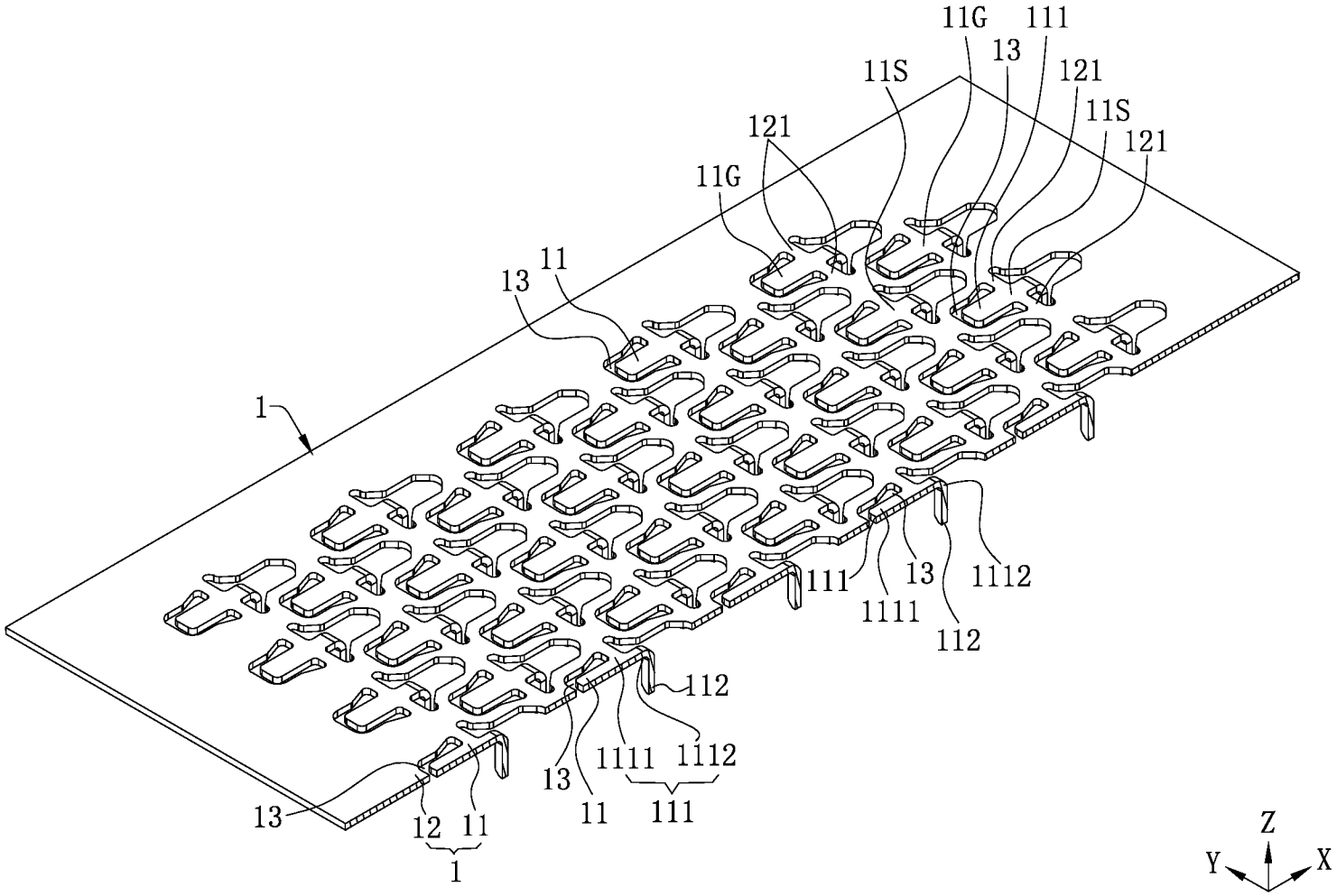
FIG. 1 is a perspective sectional view of a step 1 of a method of manufacturing an electrical connector according to certain embodiments of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector and a method of manufacturing the same.

FIG. 1 to FIG. 8 shows an electrical connector 100 according to certain embodiments of the present invention, in which a forward direction in a front-rear direction is defined as a positive direction of the X-axis, a leftward direction in a left-right direction is defined as a positive direction of the Y-axis, and an upward direction in a vertical direction is defined as a positive direction of the Z-axis.

Figure 3:
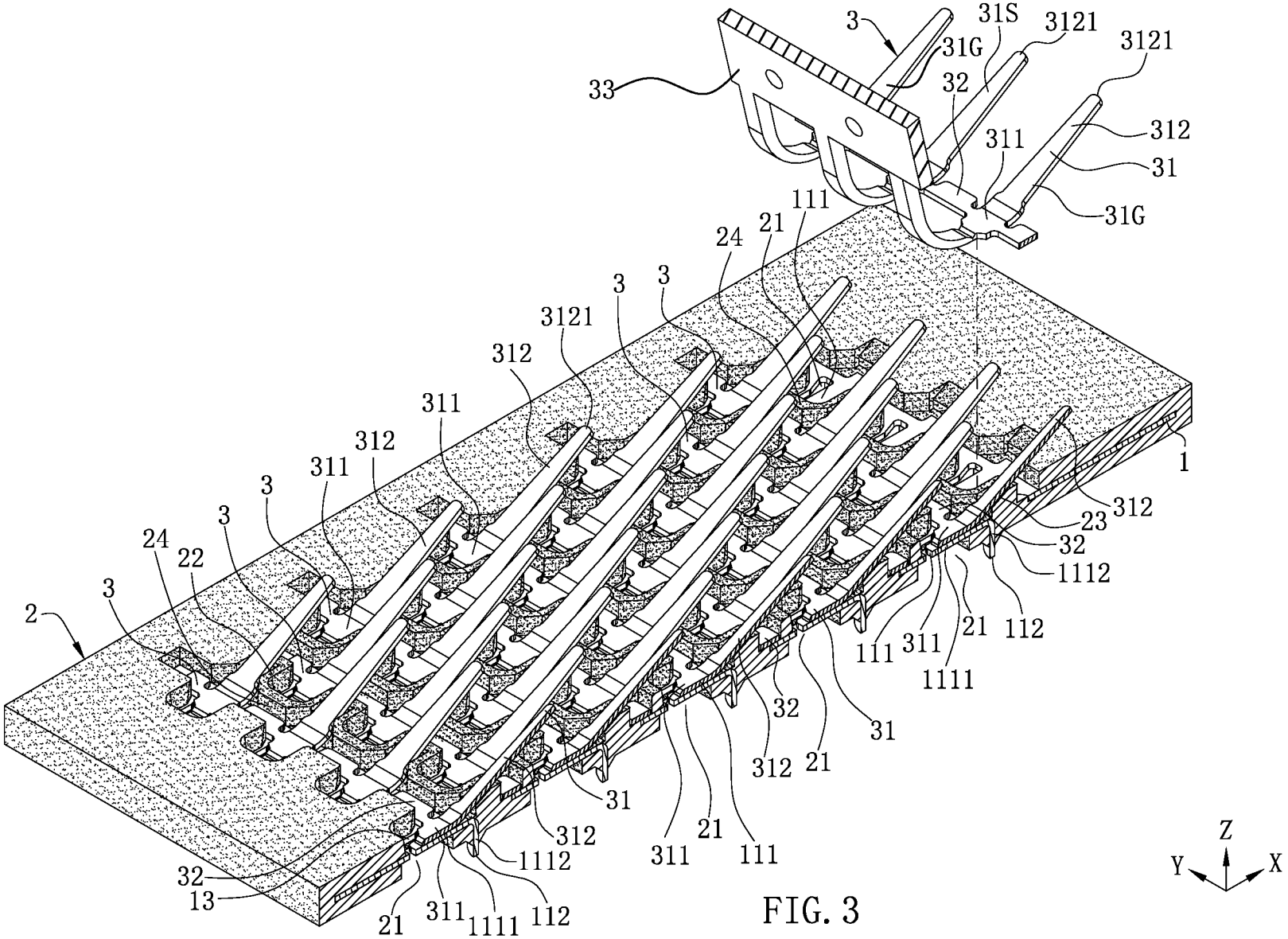
FIG. 3 is a perspective sectional view of a step 3 of a method of manufacturing an electrical connector according to certain embodiments of the present invention.
Figure 4:
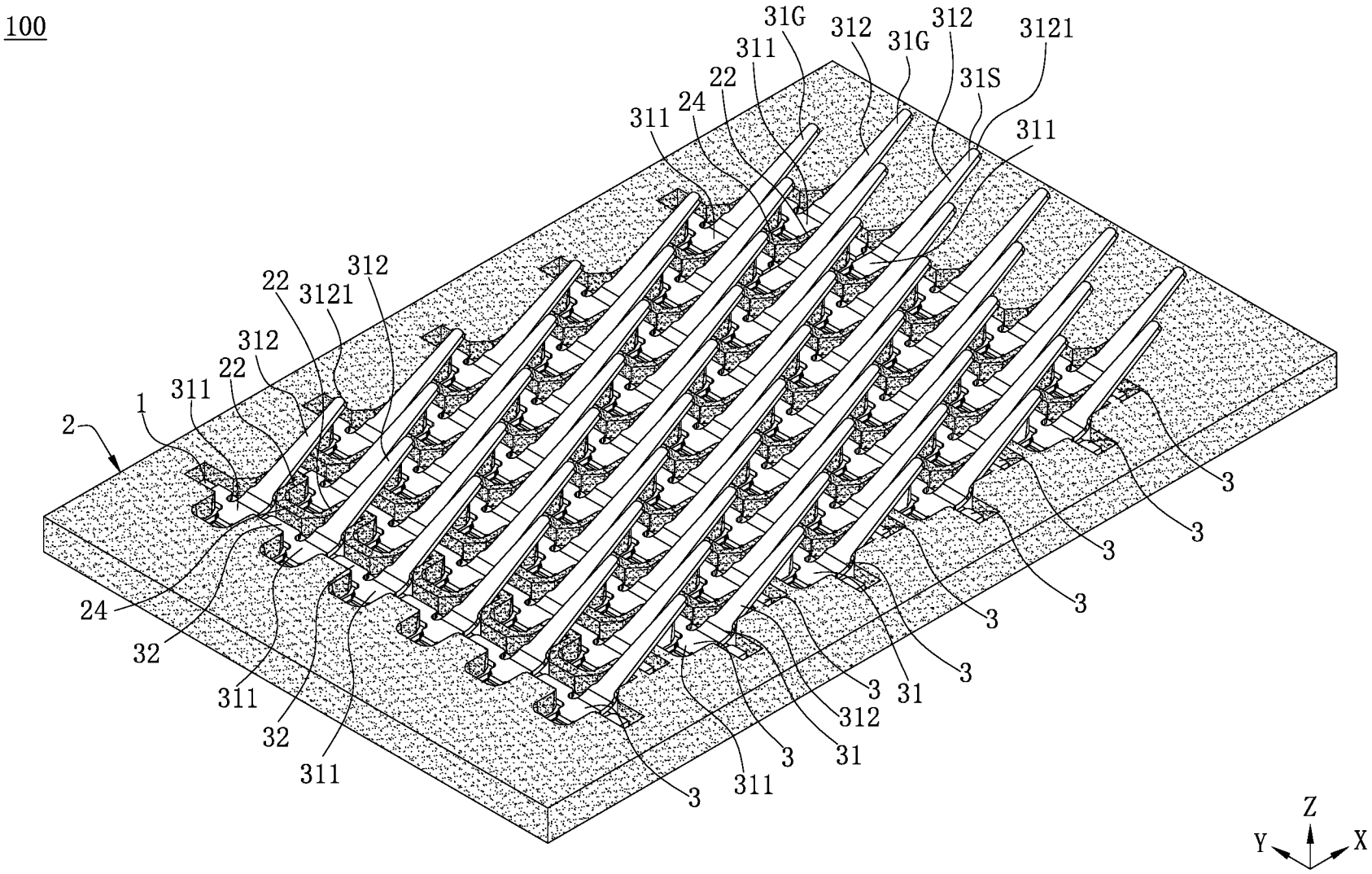
FIG. 4 is a perspective view of a step 3 of a method of manufacturing an electrical connector according to certain embodiments of the present invention.
Figure 8:
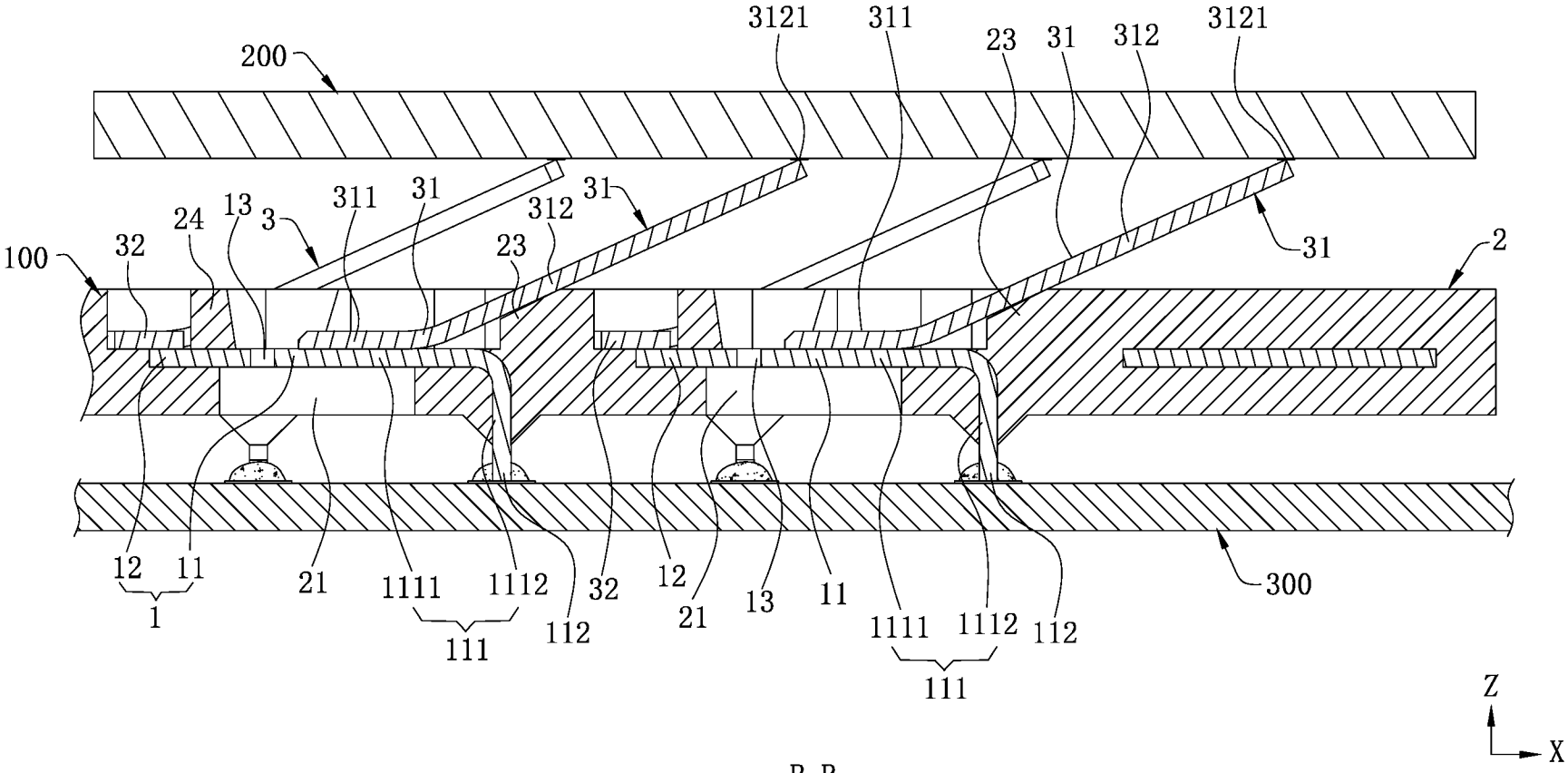
FIG. 8 is a sectional view of the electrical connector of FIG. 5 sectioned along a line B-B and mated with a mating component and a circuit board.

As shown in FIG. 3, FIG. 4 and FIG. 8, the electrical connector 100 is used to electrically connect a mating component 200 to a circuit board. The electrical connector 100 includes a lower metal plate 1, an insulating body 2, and a plurality of upper metal plates 3 located above the lower metal plate 1 and fixed to the lower metal plate 1. The lower metal plate 1 and the insulating body 2 are insert-molded. In this embodiment, the mating component 200 is a chip module. In other embodiments, the mating component 200 may be other components.

Figure 6:
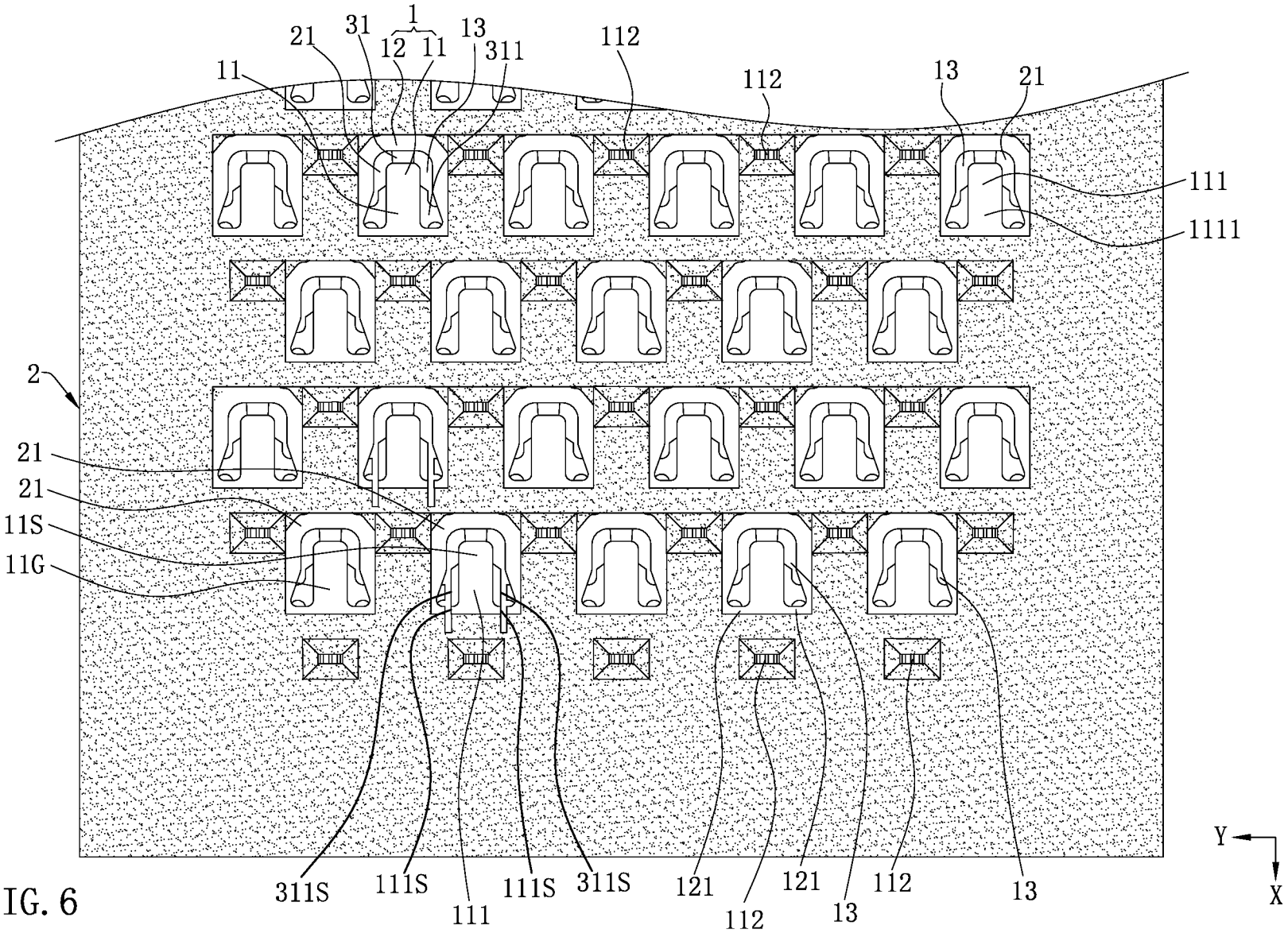
FIG. 6 is a bottom view of FIG. 4.
Figure 7:
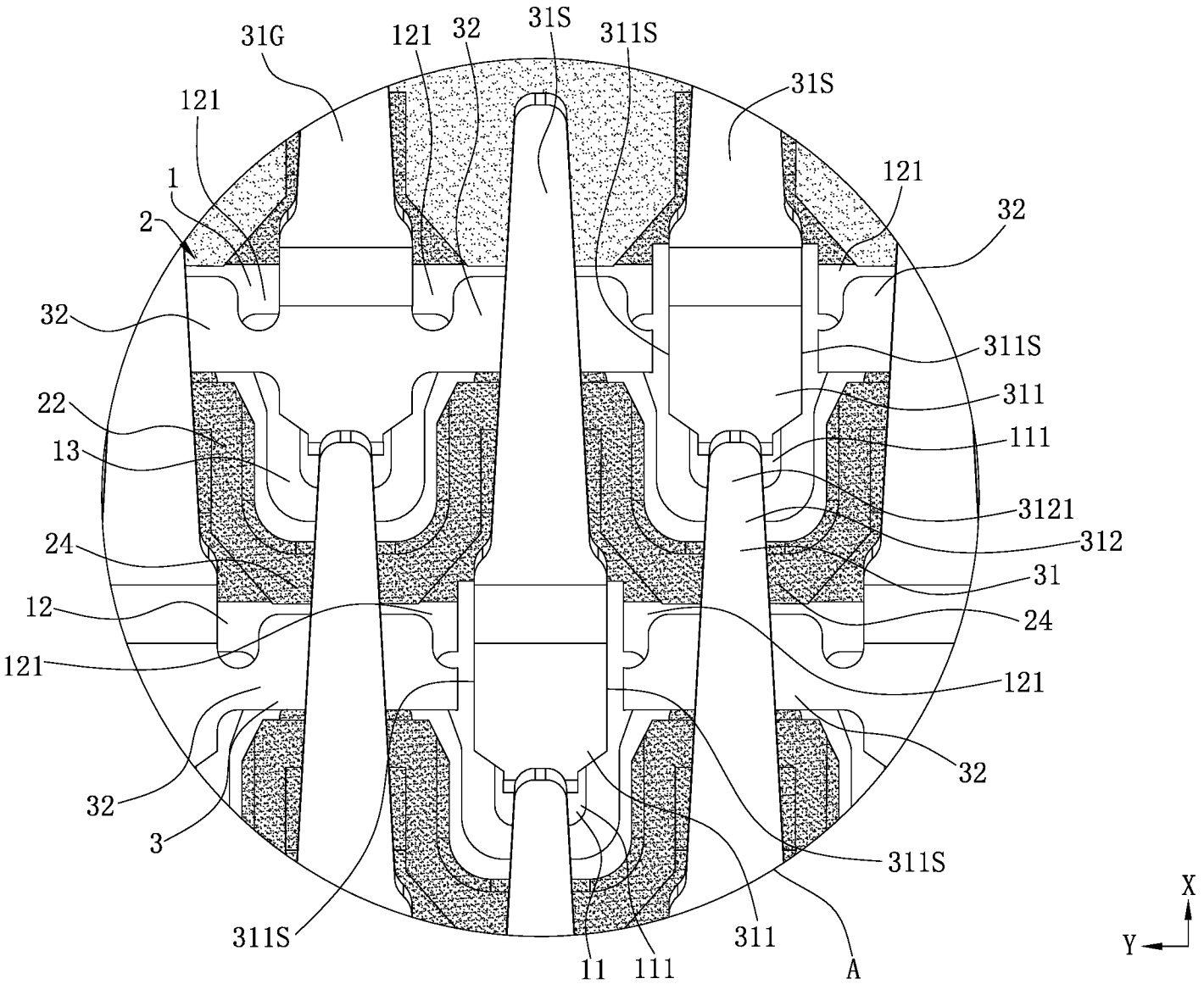
FIG. 7 is a partial enlarged view of a portion A in FIG. 5.

As shown in FIG. 1, FIG. 6 and FIG. 7, the lower metal plate 1 includes a plurality of lower terminals 11 and a conductive plate 12, and a remaining portion of the lower metal plate 1 after forming the lower terminals 11 is defined as the conductive plate 12. The conductive plate 12 surrounds outside each of the upper terminals 31. The lower terminals 11 are arranged in a plurality of columns in the left-right direction and in a plurality of rows in the front-rear direction. Each lower terminal 11 has a base portion 111 and a conductive portion 112 integrally connected to the base portion 111. A through slot 13 is formed between the base portion 111 and the conductive plate 12. The base portion 111 includes a first portion 1111 provided horizontally and a second portion 1112 extending horizontally forward from a front end of the first portion 1111 and then bending downward and extending. The conductive portion 112 is formed by extending downward from the second portion 1112, and the conductive portion 112 and the first portion 1111 are perpendicular from each other. The lower terminals 11 include a plurality of lower signal terminals 11S and a plurality of lower ground terminals 11G. The conductive plate 12 is provided with a plurality of connecting portions 121. Each connecting portion 121 is located at a front side of a corresponding through slot 13, and the conductive portion 112 is located in front of a corresponding connecting portion 121. The connecting portions 121 are integrally connected to the base portions 111 of the lower ground terminals 11G, but the connecting portions 121 are provided to be separated from the lower signal terminals 11S, thereby forming two breaking surfaces 111S at a left side and a right side of the base portion 111 of each lower signal terminal 11S. Each breaking surface 111S is formed by extending along the front-rear direction.

Figure 2:
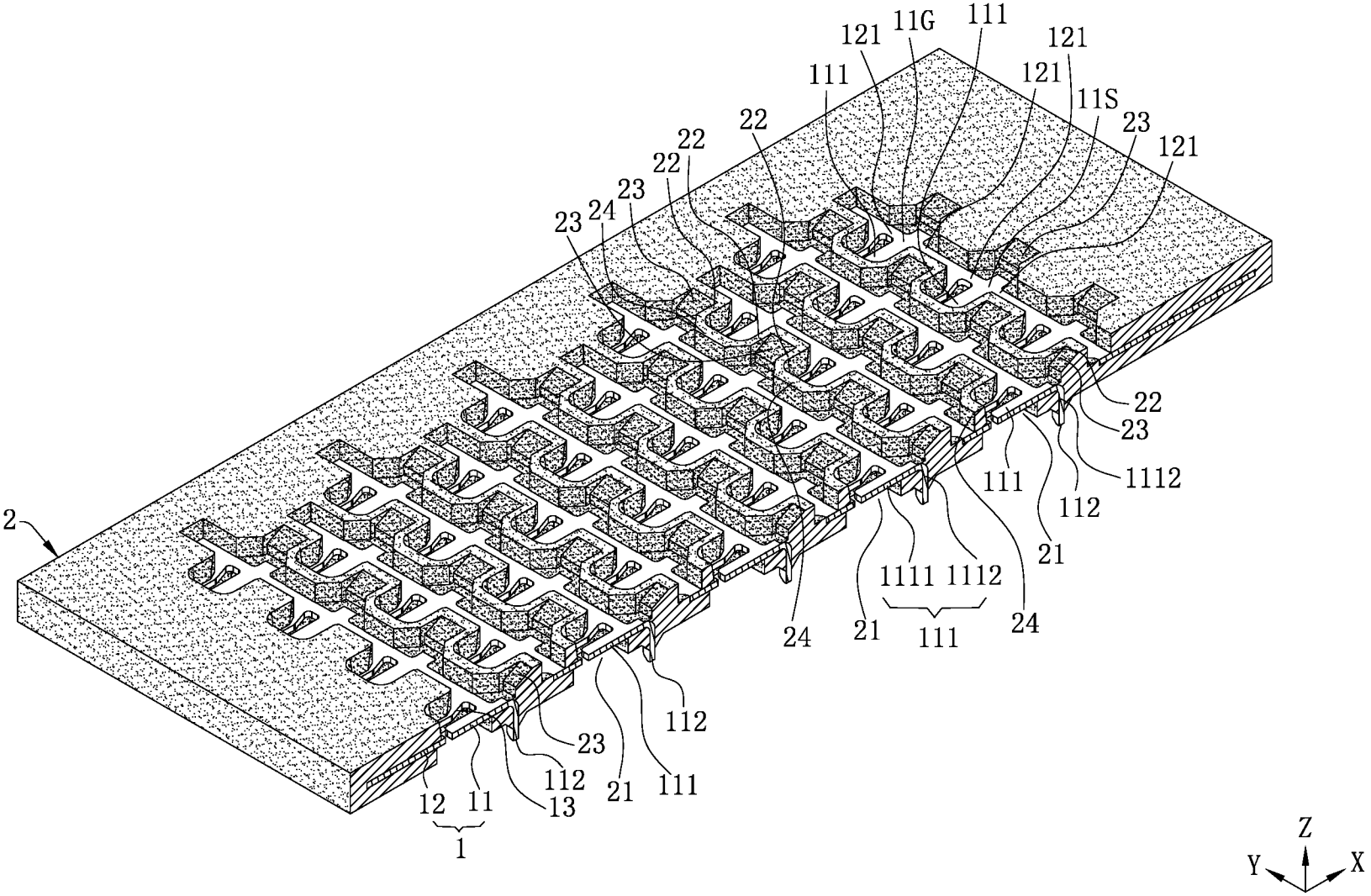
FIG. 2 is a perspective sectional view of a step 2 of a method of manufacturing an electrical connector according to certain embodiments of the present invention.

As shown in FIG. 2, FIG. 6 and FIG. 7, the insulating body 2 includes a plurality of accommodating slots 21 running vertically therethrough, and the first portion 1111 is accommodated in a corresponding accommodating slot 21. The first portion 1111 and a portion of the conductive plate 12 surroundingly provided outside the first portion 1111 are exposed downward to the corresponding accommodating slot 21. The second portion 1112 is fixed by the insulating body 2. The conductive portion 112 located therebehind is provided to correspond to an accommodating slot 21 located in front thereof in the left-right direction. The conductive portion 112 is exposed downward to the insulating body 2 to be soldered to the circuit board 300. (In other embodiments, the conductive portion may abut the circuit board 300.) The insulating body 2 further includes a plurality of position limiting portions 22 and a plurality of positioning portions 24. The position limiting portions 22 and the positioning portions 24 are provided to align along the front-rear direction. Along the left-right direction, a left side and a right side of each positioning portion 24 are integrally connected to corresponding position limiting portions 22 respectively, and the position limiting portions 22 and the positioning portions 24 are alternately provided in the left-right direction. A stopping portion 23 is integrally connected to each position limiting portion 22. The positioning portions 24 and the position limiting portions 22 all press downward on the conductive plate 12. The connecting portions 121 are exposed upward to the insulating body 2, allowing the lower signal terminals 11S to break from the conductive plate 12.

As shown in FIG. 4, FIG. 7 and FIG. 8, the upper metal plates 3 are provided at intervals in the front-rear direction. Each upper metal plate 3 includes a plurality of upper terminals 31 provided in a row along the left-right direction and a plurality of metal sheets 32, and each upper terminal 31 is located between two metal sheets 32. Each upper terminal 31 includes a fixing portion 311 and an elastic arm 312 integrally connected to the fixing portion 311. In this embodiment, two rows of the upper terminals 31 adjacent in the front-rear direction are provided to be staggered, and a portion of the elastic arm 312 is located right above the metal sheet 32 adjacent thereto in the front-rear direction. (In other embodiments, the two rows of the upper terminals 31 adjacent in the front-rear direction may be provided to align, and portion of the elastic arm 312 is located right above the upper terminal 31 adjacent thereto in the front-rear direction.) The elastic arm 312 passes forward the metal sheet 32 in front of the fixing portion 311 connected to the elastic arm 312, and a front end of the elastic arm 312 is located right above the fixing portion 311 of another upper terminal 31. The elastic arm 312 has a contact portion 3121. The contact portion 3121 is exposed upward to the insulating body 2 to abut the mating component 200. The contact portion 3121 is located in front of the fixing portion 311 and is higher than the fixing portion 311. The fixing portion 311 is located above the first portion 1111 and is fixed to the first portion 1111 by laser soldering. (In other embodiments, the fixing portion 311 may be fixed to the first portion 1111 by other methods.) A rear end of the first portion 1111 passes backward beyond a rear end of the corresponding fixing portion 311, and the front end of the first portion 1111 passes forward beyond a front end of the corresponding fixing portion 311. The metal sheet 32 is located above the conductive plate 12 and is soldered to the conductive plate 12 by laser. (In other embodiments, the metal sheet 32 may be fixed to the conductive plate 12 by other methods.) The elastic arm 312 is located below the stopping portion 23. The stopping portion 23 is used to suppress the elastic arm 312 from excessively moving downward. The position limiting portions 22 are respectively located at the left side and the right side of the elastic arm 312 to suppress the elastic arm 312 to excessively deviate in the left-right direction. The positioning portions 24 press on the conductive plate 12.

Figure 5:
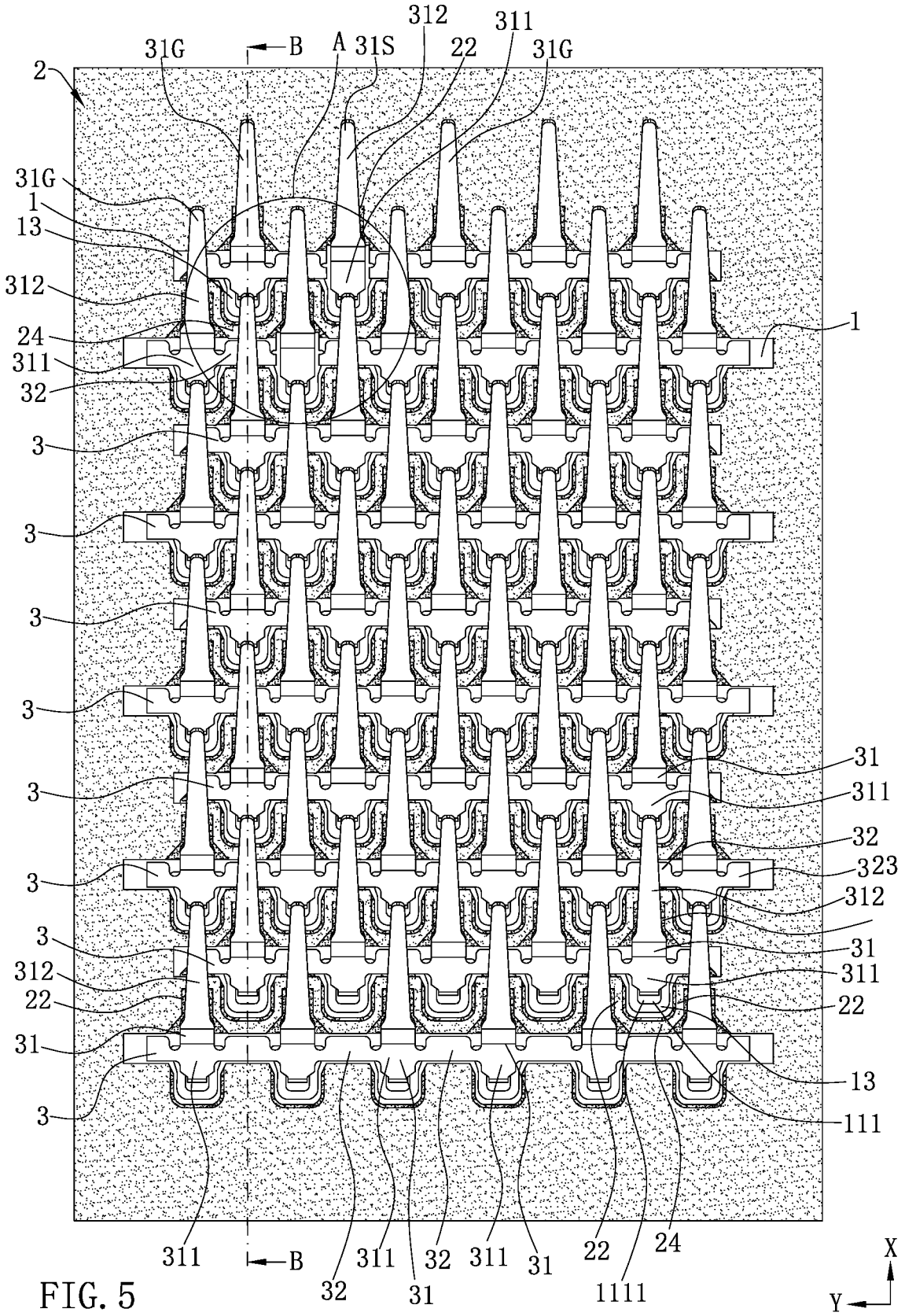
FIG. 5 is a top view of FIG. 4.

As shown in FIG. 1, FIG. 5 and FIG. 7, the upper terminals 31 include a plurality of upper signal terminals 31S and a plurality of upper ground terminals 31G. The upper ground terminals 31G are integrally connected with the metal sheets 32. The upper signal terminals 31S are provided to be separated from the metal sheets 32, thereby forming two cutting surfaces 311S at a left side and a right side of the fixing portion 311 of each upper signal terminal 31S. The two cutting surfaces 311S are exposed to the through slot 13 and are located behind the corresponding breaking surfaces 111S. Further referring to FIG. 6, each breaking surface 111S and a corresponding cutting surface 311S are located on a same vertical plane.

The method of manufacturing the electrical connector 100 according to certain embodiments of the present invention includes the following steps:

As shown in FIG. 1, step 1: providing the lower metal plate 1, and cutting the lower metal plate 1 to form a plurality of lower terminals 11. The lower terminals 11 include a plurality of lower signal terminals 11S and a plurality of lower ground terminals 11G. Each lower terminal 11 has a base portion 111 and a conductive portion 112 integrally connected to the base portion 111, and the conductive portion 112 is used to be electrically connected to the circuit board 300. A remaining portion of the lower metal plate 1 after forming the lower terminals 11 is defined as the conductive plate 12. A through slot 13 is formed between the conductive plate 12 and the base portion 111. The conductive plate 12 has a plurality of connecting portions 121 integrally connected to the base portions 111 of the lower terminals 11.

As shown in FIG. 2, step 2: fixing the lower metal plate 1 in a mold cavity of the mold, and after the mold is clamped, injecting plastic to form the insulating body 2 on the lower terminals 11 and the conductive plate 12. A portion of the base portion 111 is covered by the insulating body 2. The connecting portions 121 are exposed upward to the insulating body 2. The portions of the first portion 111 and the conductive plate 12 surrounding outside the first portion 1111 and the conductive portion 112 are exposed downward to the insulating body 2.

As shown in FIG. 3, step 3: providing a plurality of upper metal plates 3. Each upper metal plate includes a plurality of upper terminals 31 provided in a row in the left-right direction and a plurality of metal sheets 32 integrally connected to the upper terminals 31. Each upper terminal 32 includes a fixing portion 311 and an elastic arm 312 integrally connected to the fixing portion 311 and bending upward. A strip 33 is integrally connected the rear ends of the fixing portions 311 of the upper terminals 32 in a row, and the row of the upper terminals 32 are disposed on the corresponding lower terminals 11 by the strip 33. Then, the upper metal plates 3 are fixed to the lower metal plate 1 by laser soldering and are provided at intervals in the front-rear direction, such that the metal sheets 32 are located above the conductive plate 12 and are fixed to the conductive plate 12. Of two upper metal plates 3 in the front-rear direction, a portion of the elastic arm 312 of the upper metal plate 3 located therebehind overlaps with the upper metal plate 3 located in front thereof viewing along a vertical direction. Then, the strip 33 is broken from the fixing portions 311 to remove the strip 33.

As shown in FIG. 4 and FIG. 7, step 4: cutting the connecting portions 121 connected to the lower signal terminals 11S, such that the lower signal terminals 11S are separated from the conductive plate 12. The upper terminals 31 include a plurality of upper signal terminals 31S and a plurality of upper ground terminals 31G. Cutting the upper signal terminals 31S, such that the upper signal terminals 31S and separated from the metal sheets 32. At this time, a breaking position of each upper signal terminal 31S and a corresponding metal sheet 32 and a breaking position of each lower signal terminal 11S and the corresponding connecting portion 121 are located on a same vertical plane. The breaking position of each upper signal terminal 31S and the corresponding metal sheet 32 is exposed to the through slot 13. In other embodiments, it is possible to cut the connecting portions 121 connected to the lower signal terminals 11S after the step 2 and prior to the step 3, such that the lower signal terminals 11S are separated from the conductive plate 12; and in the step 4, it is possible that the breaking position of each upper signal terminal 31S and a corresponding metal sheet 32 and the breaking position of each lower signal terminal 11S and the corresponding connecting portion 121 are not located on the same vertical plane.

In sum, the electrical connector and the method of manufacturing the same according to certain embodiments of the present invention have the following beneficial effects:

(1) The upper terminals 31 are formed on the upper metal plates 3 (and not a single metal plate 3), so the length of the elastic arm 312 located therebehind is not limited by the metal sheet 32 or the upper terminal 31 located in front thereof. In addition, the terminals are formed by separate upper terminals 31 and lower terminals 11, thus achieving a short distance between the terminals and a long elastic arm 312 of each terminal. Further, the insulating body 2 is insert-molded with one lower metal plate 1, and then the upper metal plates 3 are fixed to the lower metal plate 1, thereby implementing a simple and fast mounting process of the upper terminals 31 and the lower terminals 11.

(2) Each of the left side and the right side of the fixing portion 311 of each upper signal terminal 31S is provided with the cutting surface 311S, and the cutting surface 311S is exposed to the through slot 13, thus ensuring the lower metal plate 1 not to block cutting the upper signal terminals 31S.

(3) Each breaking surface 111S and the corresponding cutting surface 311S are located on a same vertical plane, which is convenient for performing laser cutting and has a simple process.

(4) The first portion 1111 and a portion of the conductive plate 12 surroundingly provided outside the first portion 1111 are exposed to the corresponding accommodating slot 21, and the fixing portion 311 is fixed to the first portion 1111, thus preventing the plastic in the process of insert-molding the lower signal terminals 11S and the conductive plate 12 with the insulating body 2 to flow into the upper surface of the first portion 1111 and affect the soldering of the fixing portion 311 to the first portion 1111.

(5) The rear end of the first portion 1111 passes backward beyond the rear end of the corresponding fixing portion 311, and the front end of the first portion 1111 passes forward beyond the front end of the corresponding fixing portion 311, thus providing sufficient area and flatness for the soldering of the fixing portion 311 to the first portion, allowing the soldering to be easily performed, and preventing from the insufficient soldering effect.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect a mating component to a circuit board, the electrical connector comprising:

an insulating body;

a plurality of lower terminals and a conductive plate, wherein the insulating body, the lower terminals and the conductive plate are insert-molded; each of the lower terminals has a base portion and a conductive portion integrally connected to the base portion, the conductive portion is exposed downward to the insulating body to abut or be soldered to the circuit board; the lower terminals comprise a plurality of lower signal terminals and a plurality of lower ground terminals, the conductive plate is integrally connected to the lower ground terminals, and the conductive plate is separated from the lower signal terminals; and a plurality of upper terminals arranged in a plurality of columns in a left-right direction and arranged in a plurality of rows in a front-rear direction, wherein the upper terminals comprise a plurality of upper signal terminals and a plurality of upper ground terminals; each of the upper terminals and each of the lower terminals are formed separately, each of the upper terminals has a fixing portion and an elastic arm integrally connected to the fixing portion, the fixing portion is located above the base portion and is fixed to the base portion, the elastic arm has a contact portion configured to abut the mating component, the contact portion is located in front of the fixing portion and is higher than the fixing portion;

wherein a metal sheet exists between two adjacent ones of the fixing portions of the upper terminals in the left-right direction, the upper signal terminals are separated from the metal sheet, the metal sheet is integrally connected with the upper ground terminals adjacent thereto in the left-right direction and is separated from the upper ground terminals adjacent thereto in the front-rear direction, the metal sheet is located above the conductive plate and is fixed to the conductive plate, and a portion of the elastic arm is located right above the upper terminal or the metal sheet adjacent thereto in the front-rear direction.

2. The electrical connector according to claim 1, wherein the portion of the elastic arm is located right above the upper terminal adjacent thereto in the front-rear direction, and the elastic arm passes forward beyond the metal sheet.

3. The electrical connector according to claim 2, wherein a front end of the elastic arm is located right above the fixing portion of another one of the upper terminals.

4. The electrical connector according to claim 1, wherein a through slot exists between the conductive plate and the base portion, each of a left side and a right side of the fixing portion of each of the upper signal terminals is provided with a cutting surface, and the cutting surface is exposed to the through slot.

5. The electrical connector according to claim 4, wherein each of a left side and a right side of the base portion of each of the lower signal terminals is provided with a breaking surface, and the breaking surface and the corresponding cutting surface are located on a same vertical plane.

6. The electrical connector according to claim 1, wherein the insulating body has a plurality of accommodating slots running vertically therethrough, the base portion has a first portion accommodated in a corresponding one of the accommodating slots, the first portion and a portion of the conductive plate surroundingly provided outside the first portion are exposed to the corresponding one of the accommodating slots, and the fixing portion is fixed to the first portion.

7. The electrical connector according to claim 6, wherein the first portion is provided horizontally, the fixing portion is fixed to the first portion by laser soldering, the base portion has a second portion extending horizontally forward from a front end of the first portion and then bending downward and extending, the second portion is fixed by the insulating body, the conductive portion is formed by extending downward from the second portion, a rear end of the first portion passes backward beyond a rear end of the corresponding fixing portion, and the front end of the first portion passes forward beyond a front end of the corresponding fixing portion.

8. A method of manufacturing an electrical connector, the electrical connector configured to electrically connect a first mating component and a second mating component, the method comprising:

step 1: providing a lower metal plate, and cutting the lower metal plate to form a plurality of lower terminals, wherein each of the lower terminals has a base portion and a conductive portion integrally connected to the base portion, the conductive portion is configured to be electrically connected to the circuit board, a remaining portion of the lower metal plate after forming the lower terminals is defined as a conductive plate, and the conductive plate has a plurality of connecting portions integrally connected to the base portions of the lower terminals;

step 2: forming an insulating body on the lower terminals and the conductive plate by insert-molding, wherein a portion of the base portion is covered by the insulating body, and the conductive portion is exposed downward to the insulating body;

step 3: providing a plurality of upper metal plates, wherein each of the upper metal plates comprises a plurality of upper terminals provided in a row in a left-right direction and a plurality of metal sheets integrally connected to the upper terminals, each of the upper terminals comprises a fixing portion and an elastic arm integrally connected to the fixing portion and bending upward, the elastic arm has a contact portion configured to abut the mating component, the contact portion is located in front of the fixing portion and is higher than the fixing portion, the upper terminals comprise a plurality of upper signal terminals; the upper metal plates are fixed to the lower metal plate and are provided at intervals in a front-rear direction, such that of two of the upper metal plates in the front-rear direction, a portion of the elastic arm of the upper metal plate located therebehind overlaps with the upper metal plate located in front thereof viewing along a vertical direction, the fixing portion is located above the base portion and is fixed to the base portion, and the metal sheets are located above the conductive plate and are fixed to the conductive plate; and step 4: cutting the upper signal terminals, such that the upper signal terminals are separated from the metal sheets.

9. The method according to claim 8, wherein in the step 3, the portion of the elastic arm is located right above the metal sheet adjacent thereto in the front-rear direction, and the elastic arm passes forward beyond the metal sheet adjacent thereto in the front-rear direction.

10. The method according to claim 8, wherein the lower terminals comprise a plurality of lower signal terminals; and after the step 3, the connecting portions connected to the lower signal terminals are cut, such that the lower signal terminals are separated from the conductive plate.

11. The method according to claim 10, wherein a breaking position of each of the lower signal terminals and a corresponding one of the connecting portions and a breaking position of each of the upper signal terminals and a corresponding one of the metal sheets in the step 4 are located on a same vertical plane.

12. The method according to claim 8, wherein when the lower terminals are cut in the step 1, a through slot is formed between the conductive plate and the base portion, and a breaking position of each of the upper signal terminals and a corresponding one of the metal sheets in the step 4 is exposed to the through slot.

* * * * *